US006494401B2

(12) United States Patent
Bradshaw et al.

(10) Patent No.: US 6,494,401 B2
(45) Date of Patent: Dec. 17, 2002

(54) ARBOR FOR SECURING REELS ON A SHAFT

(76) Inventors: Franklin C. Bradshaw, 8621 E. Cheryl Dr., Scottsdale, AZ (US) 85258; Craig D. Churchill, 17826 N. 43rd. Pl., Phoenix, AZ (US) 85032

( * ) Notice: Subject to any disclaimer, the term of this patent is extended or adjusted under 35 U.S.C. 154(b) by 0 days.

(21) Appl. No.: 09/771,468

(22) Filed: Jan. 26, 2001

(65) Prior Publication Data

US 2001/0025899 A1 Oct. 4, 2001

Related U.S. Application Data

(60) Provisional application No. 60/178,384, filed on Jan. 27, 2000.

(51) Int. Cl.[7] ..... B65H 75/24
(52) U.S. Cl. ..... 242/573.7; 279/2.11; 279/2.23
(58) Field of Search ..... 242/573.7, 573.2; 279/2.1, 2.11, 2.23

(56) References Cited

U.S. PATENT DOCUMENTS 537,789 A * 4/1895 Sinclair ..... 242/573.2
2,097,287 A * 10/1937 McKenna ..... 242/573.2
2,443,243 A * 6/1948 Hayssen ..... 242/573.7
2,670,905 A * 3/1954 Grauer ..... 242/573.7
2,739,764 A * 3/1956 Lanstrom ..... 242/573.7
3,637,156 A * 1/1972 Shepherd ..... 242/573.7
4,469,288 A * 9/1984 Pontes ..... 242/573.2
5,996,929 A * 12/1999 Mazodier ..... 242/573.7
6,113,025 A * 9/2000 Kudrus ..... 242/573.7

* cited by examiner

*Primary Examiner*—John M. Jillions
(74) *Attorney, Agent, or Firm*—Gregory J. Nelson

(57) ABSTRACT

An arbor for temporarily securing a reel to the shaft of a machine such as an unwind machine. A plurality of blades are extendable and retractable from a cylindrical body by means of an axially shiftable cam assembly. The cam assembly shifts in response to an actuator which is mounted on the end of the support shaft which extends from one end of the arbor. In one embodiment the cam assembly carries annular cam members and in another embodiment the cam assembly defines cam grooves having ramps which receive bearing member in cooperation with aligned cam grooves in the blades.

2 Claims, 5 Drawing Sheets

(EXTENDED)

(RETRACTED)

(RETRACTED)

ARBOR FOR SECURING REELS ON A SHAFT

This Application is based on provisional application No. 60/178,384, filed Jan. 27, 2000, titled "Expandable Arbor For Securing Reels on A Shaft."

FIELD OF THE INVENTION

The present invention relates to the field of winding and unwinding machines and more particularly relates to an arbor for securing reels of web material and the like to a shaft so they may be wound onto or off of the reel.

BACKGROUND OF THE INVENTION

Various types of materials such as webs of paper, plastic film, as well as wire and similar materials are wound onto or wound off of a reel during processing and handling. Winding of the material, such as web material, is accomplished by securing the core of the reel to a rotating mandril or shaft. Similarly, wire and cable are wound onto the core of a reel may be unwound or payed out as they are installed. Web type materials may be further processed after winding or unwinding by slitting, cutting or applying various coatings.

Accordingly, when processing or utilizing materials which are wound onto or unwound or payed off reels, it is necessary to provide means for temporarily securing the core of the reel to a shaft during the winding or unwinding operation in a manner to facilitate installation, removal and rotation of the reel.

Various types of prior art devices can be found for securing a material reel on a shaft or arbor.

U.S. Pat. No. 2,762,577 shows a device in which segments of a cylindrical body are arranged for radial movement relative to a common center.

U.S. Pat. No. 4,061,289 shows a vertical pay off reel with expanding segments which are actuated by sleeves traveling on a center shaft. A somewhat similar arrangement utilizing a plurality of circumferentially expandable segments and expansible mandril are shown in U.S. Pat. No. 2,682,924.

U.S. Pat. No. 3,128,060 shows a holder in which segments are urged radially which segments are arcuate in cross section.

U.S. Pat. No. 4,159,085 shows a pay-off reel of the type called a top hat or basket-type which incorporates a plurality of circumferentially spaced, radially movable spacer arms positioned for movement into and out of a slotted cylindrical body. The mechanism within the cylindrical body is operable from the exterior and imparts horizontal motion to the spacer arm to position the spacer arms to match the inner diameter of the coil such as a coil of wire positioned on the pay-off reel.

An expandable chuck for winding web material on a core is shown in U.S. Pat. No. 4,079,896. The chuck is attached to the rotating mandril by means of a locking ring. The chuck includes arbor and shoe segments in camming relationship so that relative movement is effective to increase the diameter of the shoe segments. The core upon which the web material is to be wound is placed over the shoe segments which are then extended by rotation of an adjusting nut to secure the core to the shoe segments.

Other expandable arbor arrangements utilize inflatable bladders which can be selectively inflated by admission of air and deflated when the core is to be removed or positioned on the mandril.

SUMMARY OF THE INVENTION

The present invention relates to an arbor having expandable and retractable blades or paddles engageable with the core of reels on which material of various types may be wound. The arbor may be used for reels during a winding operation or during an unwinding operation when the material is to payed off the reel. While the present invention will work well with most types of reels, the invention has particular application to materials such as webs of paper or plastic which either are unwound from a reel or wound onto a reel during processing. The processing may be the application of a particular coating to the web or may be a process such as slitting the web into sections which may then be used for labels and similar applications.

Briefly, the present invention provides an arbor which may be used with various types of winding and unwinding equipment. One particular application is in connection with devices which provide controlled winding or unwinding of reel-mounted webs such as webs of paper or plastic.

The arbor of the present invention, sometimes referred to as a collet or chuck, has a generally cylindrical body which is attached to a support shaft. The support shaft is rotatably supported in a suitable device such as within the bearings of an unwind machine and may be driven by a pulley or other drive mechanism. The arbor has an arbor tube which is closed at one end by an end cap. A cam assembly is reciprocal within the cylindrical body of the arbor tube. In one embodiment, the cam assembly comprises an elongate, axially extending center rod having annular cams positioned at opposite ends of the rod. The cams each have generally conical surfaces which define an inclined ramp.

The arbor tube defines two or more longitudinally extending openings. Each of the openings receives an arbor blade or paddle which has a flat outer surface which is parallel to the outer surface of the arbor tube. The inner surface of the blade defines a pair of spaced-apart cam follower surfaces which, when the blades are installed, are engaged by the inclined ramp surfaces of the cams on the cam assembly within the arbor tube so that reciprocation of the cam assembly will radially extend and retract the blades.

An operator, such as a pneumatic actuator, is housed within the support shaft. The operator has an axially extending actuator rod engaging one end of the cam assembly. By selectively pressurizing the actuator, the cam assembly is moved axially to cause the blades to expand radially outward to a position engaging the interior surface or core of the reel mounted on the arbor tube. When the cam assembly is moved in the opposite direction, the blades retract within their openings out of engagement with the reel core engagement with the reel core to allow the reel to be removed and replaced. Preferably the blades are equally spaced around the cam tube with four blades positioned at 90° intervals being preferred.

In another embodiment, the arbor tube houses an axial push cam assembly. Two or more blades are received in longitudinal slots in the tube. Cooperating cam slots are provided in the tube and the blades and contain a bearing member such as a ball bearing. Linear actuation of the tube will cause a camming action to extend or retract the blades.

BRIEF DESCRIPTION OF THE INVENTION

The above and other objects and advantages of the present invention will be more fully understood from the following description, claims and drawings in which:

DETAILED DESCRIPTION OF THE INVENTION

Figure 1:
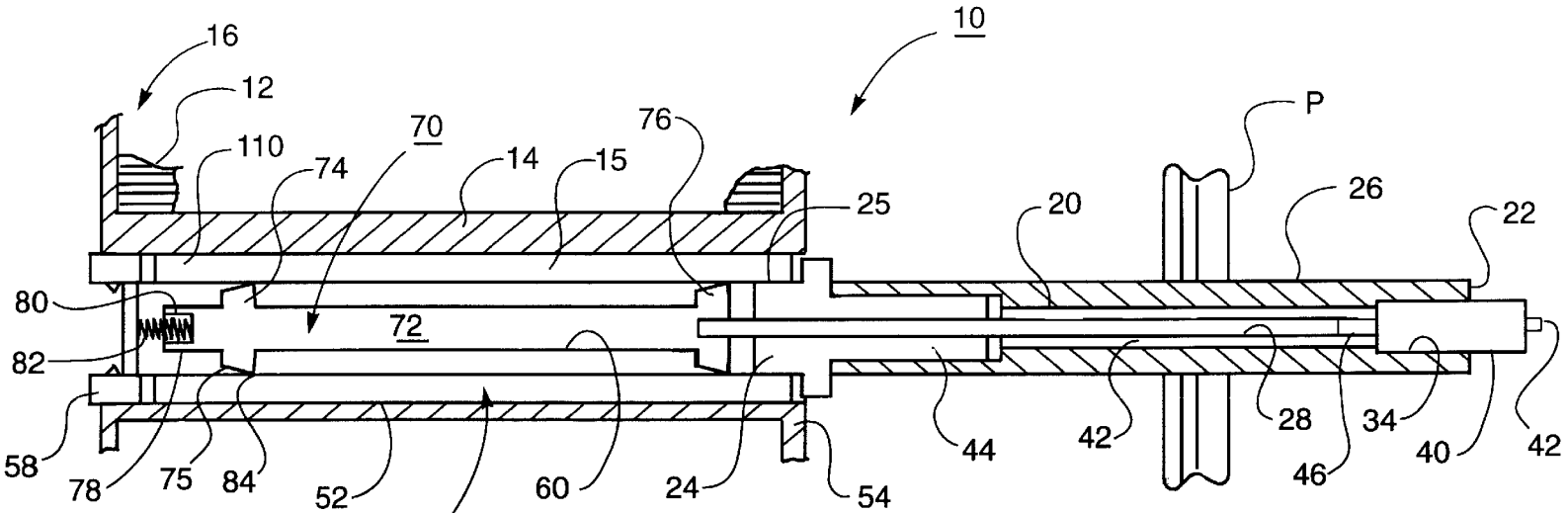
FIG. 1 is a longitudinal view, partly in section, showing a representative reel positioned on the expandable arbor of the present invention.
Figure 2:
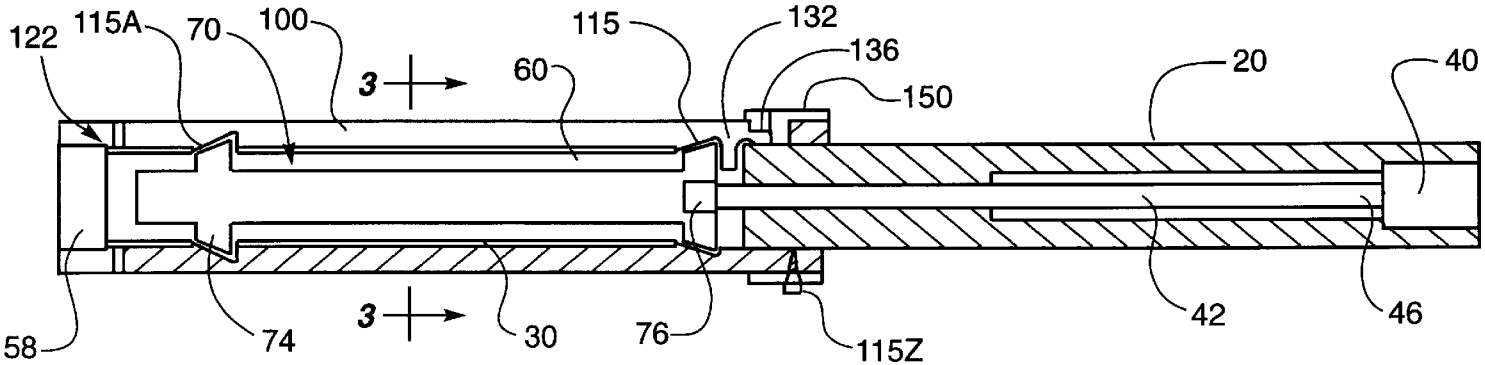
FIG. 2 is a longitudinal cross sectional view of the arbor of the present invention with the blades shown in a retracted position.

Turning now to the drawings, FIGS. 1 and 2 show an embodiment of the expandable arbor of the present invention which is generally indicated by the numeral 10. A representative roll of material such as a web of paper or film 12 is wound about the central mandril 14 of reel 16 having a core 15 which is positioned on the arbor 10. The reel 16 is shown having opposed circular side walls which reel is the type commonly used for various materials. As mentioned above, the arbor 10 of the present invention may be utilized with a wide variety of material reels and may be both used for applications where material is to be unwound from a reel or spool as well as applications where the material is to be wound onto a reel or spool from another source. A primary advantage of the arbor of the present invention is that it facilitates easy installation and removal of the reel. Further, the arbor of the present invention is self-centering so that it securely positions the reel of material so as to minimize any eccentric motion which may induce a wobble when the reel is rotated at high speeds.

The arbor 10 includes a support shaft 20 which has an inner end 22 and an outer end 24. The shaft 20 may be a component of an existing machine to which the arbor 10 is attached. The outer end 24 of the support shaft is secured to the arbor tube 30 by interference fit, shrink fit or other mechanical attachment at 25.

The support shaft 20 has an outer round surface 26 which may be suitably supported for rotation. Typically, the shaft 20 is mounted within the bearings of a machine such as a winding machine of the type well known and conventionally used in the art and rotatively driven by a drive represented by pulley "P." The body of the support shaft defines an axially extending central bore 28 having an enlarged bore 34 at end 22. An actuator 40, preferably a pneumatic actuator, is mounted in bore 34 at the end 22 of the support shaft.

A rotating union 42 is provided for connecting the actuator 40 to a source of pneumatic pressure. The pneumatic actuator 40 has a piston rod 46 that extends axially and engages actuator rod 42 which is axially slidable with journal 44 located within end 24 of the support shaft. End 24 of the support shaft is received within the inner end of the arbor tube as mentioned above.

It will be appreciated that pressurization of the head end of pneumatic cylinder 40 will extend piston rod 46 causing the actuator rod 42 to move axially within bore 28 in a leftward direction as seen in FIG. 1. As will be described below, this movement will cause the arbor blades 100 to expand engaging the core of a reel or spool supported on the arbor.

The arbor tube 30 has an outer. generally circular surface 52 which at end 54 receives end 24 of the support shaft. The opposite end of the arbor tube 30 is enclosed by end cap 58 which may be installed by a press fit or threaded so that it can be removed for servicing or repair of the arbor assembly if necessary. The arbor tube 30 defines a centrally extending bore 60 having an internal diameter closely approximating the outer diameter of the support shaft.

Figure 4:
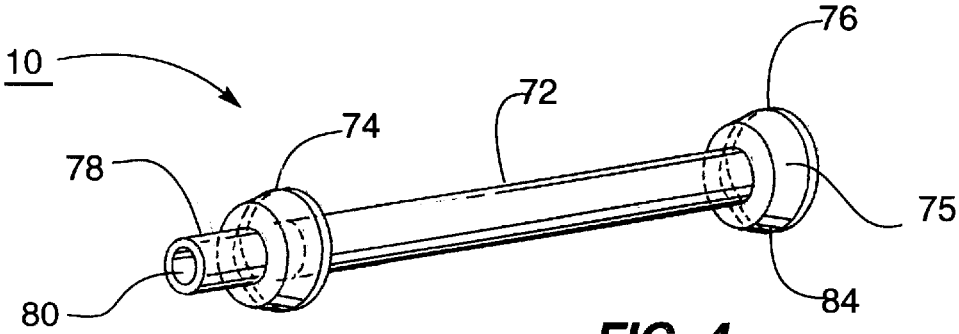
FIG. 4 is a perspective view of the cam assembly.

A cam assembly 70 is reciprocal within the bore 60 of the arbor tube. Reciprocation of the cam assembly is controlled by the pneumatic actuator 40 as the distal end of the actuator rod 42 engages the right end of the cam assembly 70 as seen in FIGS. 1 and 2. The cam assembly 70 is best seen in FIG. 4 and includes an axially extending rod 72 which carries a pair of spaced-apart annular cam members 74 and 76 at its opposite ends. A tubular projection 78 extends from cam 74. The tubular projection 78 defines a central bore 80 that receives a return spring 82 which is seated within bore 80 with the opposite end of the return spring abutting the inner surface of the end cap 58 so that the cam assembly 70 is biased or urged rightward into the retracted position seen in FIG. 1.

The cam members 74 and 76 are similarly configured, each having a major diameter 84 which closely corresponds to the inner diameter of the arbor tube but having sufficient clearance to allow the cam assembly 70 to reciprocate therein. A somewhat truncated conical cam surface 75 converges inwardly from the major diameter 84 of each of the cams 74 and 76.

Figure 3:
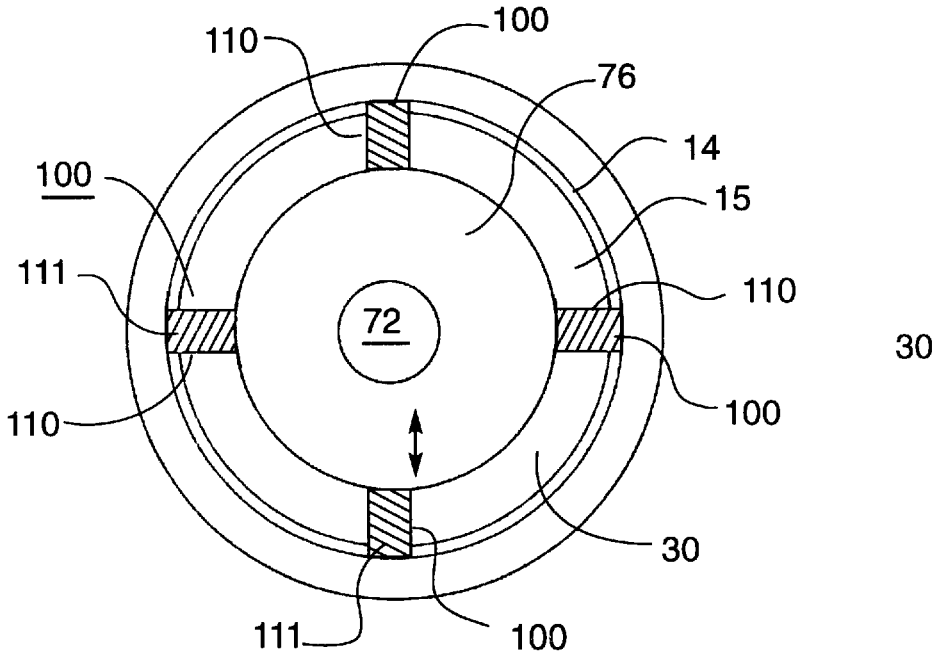
FIG. 3 is a sectional view taken along line 3—3 of FIG. 2, showing the blades extended.

The cam surfaces 75 engage a cam follower on the extendable and retractable paddles or blades 100. A plurality of blades 100 are radially disposed about the arbor tube and received in axially extending slots 110 in the arbor tube. Preferably the blades and slots are positioned at equally spaced-apart locations around the circumference of the arbor tube, as for example spaced at 90° or 120°. The blades have a retracted position as seen in FIG. 2 in which they are withdrawn within their respective slots 110 and do not project above the outer surface of the arbor tube. In the extended position shown in FIG. 3, the blades project outwardly from the outer surface of the arbor tube to engage the core 15 of the reel 14 securing it for rotation in a centered position with respect to its axis of rotation.

Figure 5:
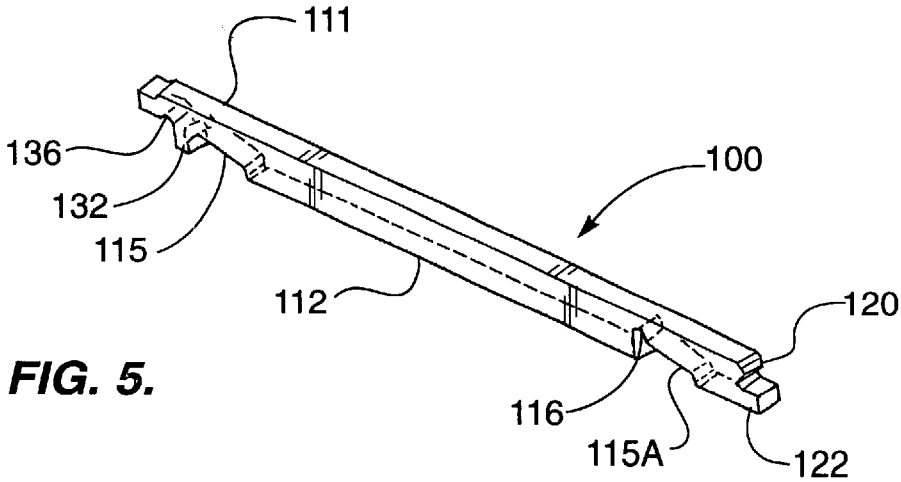
FIG. 5 is a perspective view of a representative blade or paddle.
Figure 6:
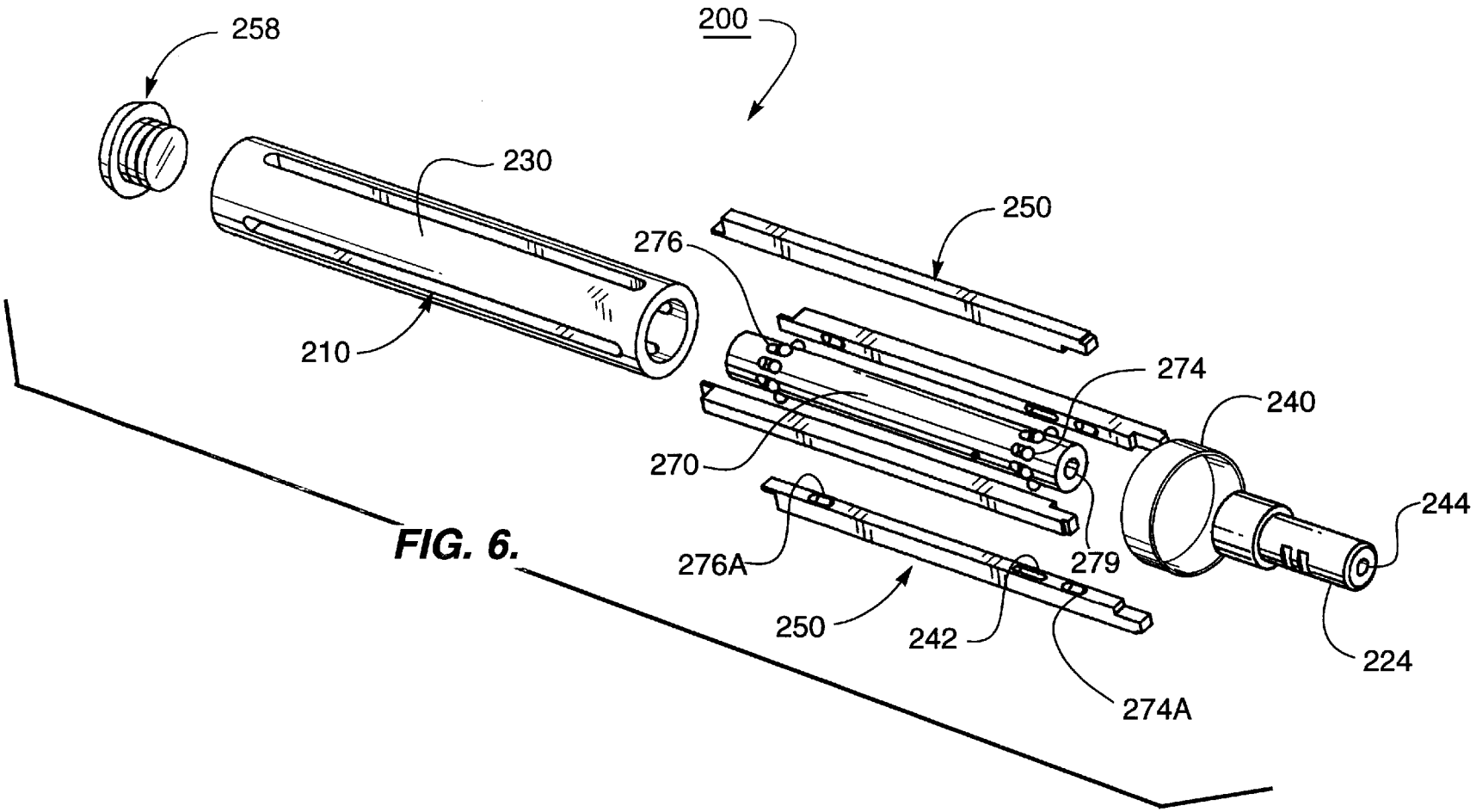
FIG. 6 is an exploded perspective view of another embodiment of the invention.

The blades 100 are best seen in FIG. 5. Blades 100 each are elongate having a linear outer surface 111 and an inner, parallel surface 112. Followers in the form of angular ramps 115 and 115A extend upwardly and outwardly in surface 112 near the ends of the blade. The ramps are located so as to align with the cams 74 and 76 of the cam assembly 70. When the cam assembly is in the retracted or nonactuated position, the ramps allow the blades to assume a retracted position with blade surface 111 at or slightly below the outer cylindrical surface of the arbor tube as the major diameters 84 of the cam members are seated within recesses 116 at the ends of the ramps. As the cams are urged leftward, the outer major diametral surface 84 of the cam members 74 and 76 will engage the ramp surfaces 115, 115A causing the blade to be moved outwardly. Since cam members 74 and 76 are located at both ends of the blades, the blades will be caused to move uniformly and evenly outward, engaging the internal core of the reel uniformly and causing the reel to be centered and secured with respect to the arbor tube.

The outer end of the blades 100 each define a small notch or recess 120 and an axially extending projection 122. It will be seen that the projection 122 will engage the inner diameter of the arbor bore to retain the outer end of the blade in position. The opposite or inner end of the blade carries a radially extending projection 132 spaced slightly inward from the end of the blade. The outer surface of the inner end of the blade defines an annular notch 136. The blades may be inserted into their respective slots as best seen in FIGS. 1 and 2 with the projection 122 seated within the outer end of the arbor. The inner end of the blades are then retained by circular collar 150 about the inner end of the arbor tube which can be secured in place by a set screw 152. The collar abuts the projection 136 on the blades.

This construction of the blades facilitates not only convenient assembly of the arbor but also facilitates maintenance and repair if it becomes necessary to replace one or more of the blades or paddles. This can be accomplished by simply loosening the set screws 152 on the retaining collar 150 and axially sliding the collar free of the arbor allowing the blades to be removed. The reverse procedure occurs once new blades are inserted and can be locked in place by repositioning the collar at the end of the arbor tube.

In use, the arbor 10 is secured to a suitable drive unit such as an unwind or wind device. The reel is positioned over the arbor shaft with the actuator positioned to retract the blades. Once the core of the reel is positioned over the arbor, the actuator 40 is pressurized causing the actuator rod 42 to be axially extended against the force of spring 82 forcing the cam assembly leftward. The cam elements 75, 76 on the end of the cam assembly will engage the corresponding cam surfaces 115, 115A of the blade causing the blade to extend outwardly so surface 111 engages the reel core securing the reel for rotation in a centered position.

Another embodiment of the present invention is shown in FIGS. 6 to 9 and is indicated by the numeral 200. In this embodiment a cylindrical arbor tube 230 is provided with a plurality of equally spaced longitudinal slots 210. One end of the tube is closed by an end cap 258 and the other end receives adapter 224 which is received within the end of a support shaft as shown in FIG. 1. A bore 244 receives a rod which is reciprocated by a pneumatic actuator also as shown in FIG. 1.

A cylindrical push cam assembly 270 has a blind bore 279 which receives the end of the actuator rod. The push cam assembly has a plurality of circumferentially spaced-apart cam grooves 274 and 276 adjacent its opposite ends. The grooves 274, 276 each have a ramp surface 275 which inclines upwardly from end 279.

Figure 7:
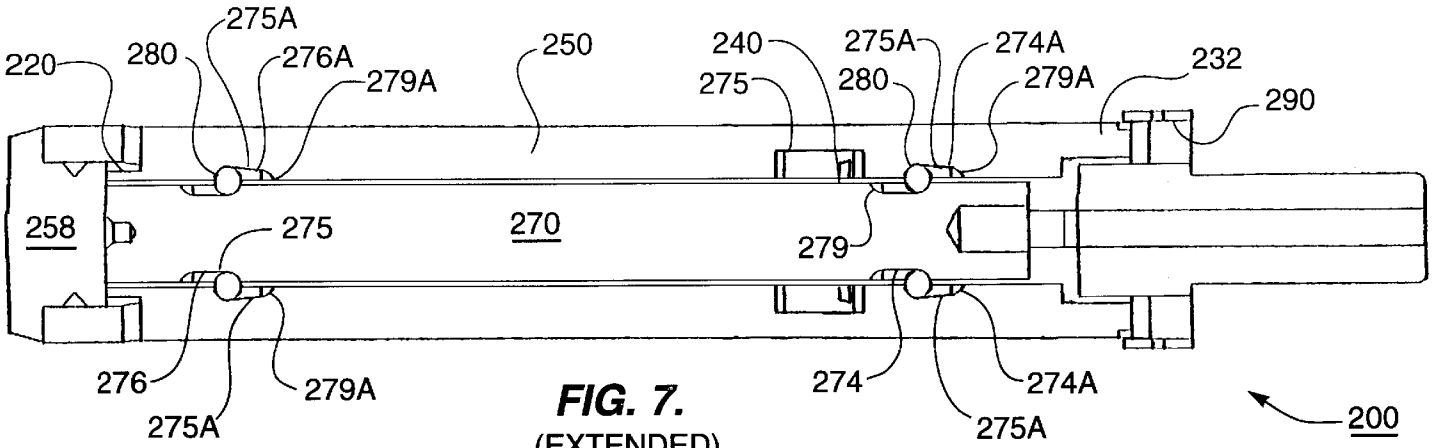
FIG. 7 is a cross-sectional view of the embodiment of FIG. 6 with the blades shown extended.
Figure 8:
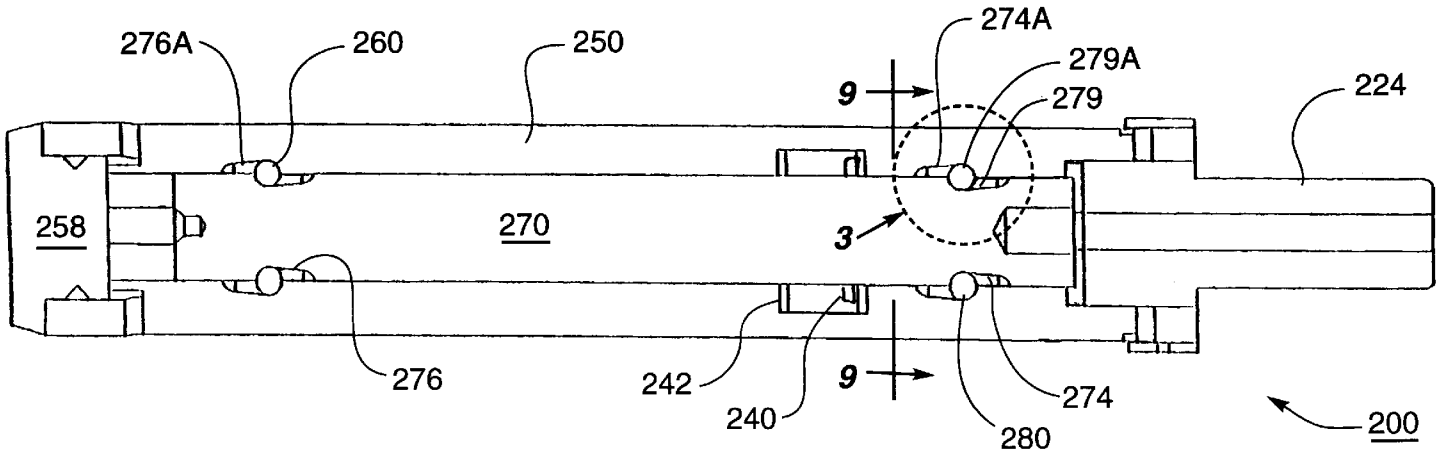
FIG. 8 is a cross-sectional view similar to FIG. 7 with the blades retracted.
Figure 8A:
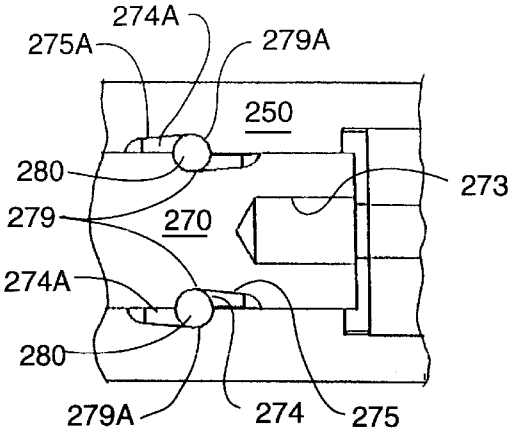
FIG. 8A is a detail view as indicated in FIG. 8.
Figure 9:
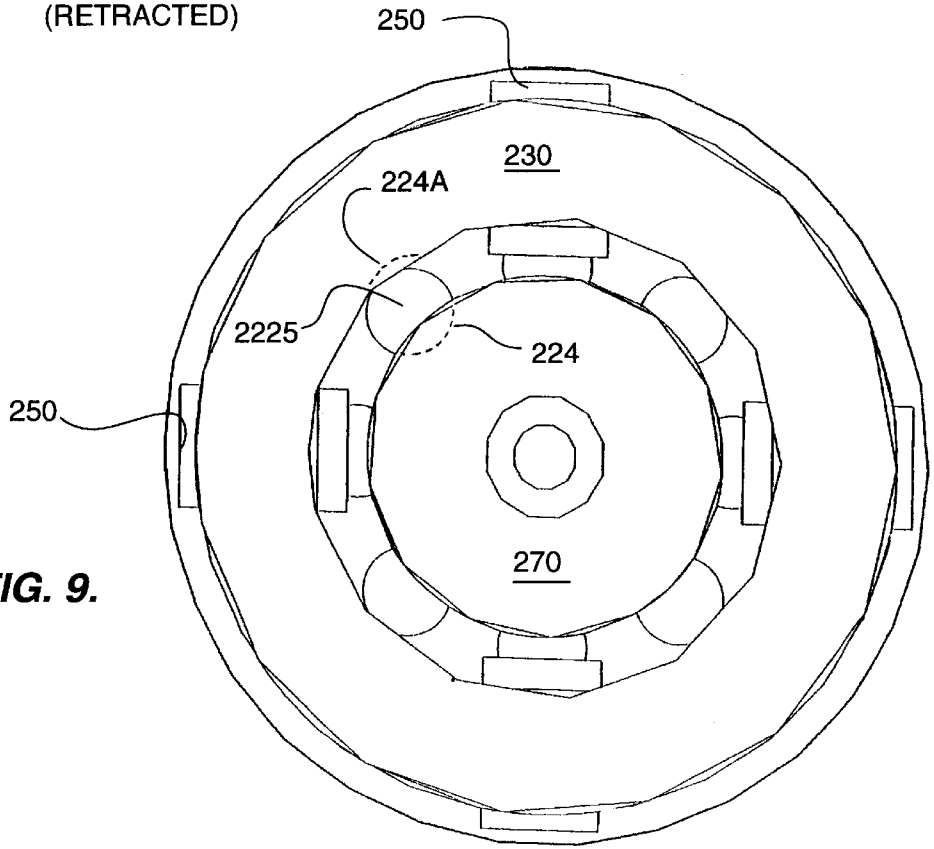
FIG. 9 is a cross-sectional view taken along line 9—9 of FIG. 8.

Cam blades 250 are positioned at spaced locations in the slots 210 in the tube each having an inner surface which has spaced-apart cam grooves 274A and 276A which taper slightly downwardly along ramp surface 275A from end 279A. A ball bearing 280 is positioned in each of the aligned cam grooves and, in the retracted position shown in FIGS. 8 and 8A, the bearings 280 seat in the aligned deep ends 279, 279A of the grooves. The has a diameter closely corresponding to the depth of the grooves at ends 279, 279A and the clearance between the tube and blades surfaces. When the cam 270 is moved rightward by the actuator rod to the position seen in FIG. 7, the cam 270 will move the bearings 280 to the shallower end of the aligned grooves causing the blade to be extended or forced outwardly to a position engaging the inner core surface of the reel as seen in FIGS. 7 and 9.

A collar 290 retains the blades within the slots engaging a shoulder 232 on the inner ends of each blade. The outer ends of the blades are retained by flange 220.

Additional aligned bearing grooves 224, 224A are provided at circumferentially spaced locations in the tube 230 and the cam 270 between adjacent blades. These grooves, best seen in FIG. 9, each receive a bearing 225 and provide for smoother operation and movement of the cam.

The blades are retained against tilting by pins or set screws 240 in the arbor tube which are received in slots in the inner surface of the blades.

The operation of the arbor 200 is generally similar to that described above with respect to FIGS. 1 to 5. Reciprocation of the cam 270 leftward, as seen in FIG. 7, will cause the blades 250 to extend as the bearings 280 move leftward along ramp surface 278A. Rightward movement of the cam to the position shown in FIG. 8 will cause the bearing members to move along the ramp surfaces to the aligned ends 279, 279A. The force applied by the reel will include this movement once the actuator rod is retracted.

It will be seen from the above that the arbor of the present invention is both effective and efficient and may be used in a wide variety of installations in which a reel is carried for repair or replacement.

It will be obvious to those skilled in the art to make various changes, alterations and modifications to the invention described herein. To the extent such changes, alterations and modifications do not depart from the spirit and scope of the appended claims. They are intended to be encompassed therein.

We claim:

1. An expandable and retractable arbor supported on a rotatable shaft for removably supplying a material reel of the type having a generally cylindrical core, said arbor comprising:

(a) a generally cylindrical axially extending arbor tube having a bore defining at least two spaced-apart generally longitudinal slots, said arbor tube attachable to a retractable shaft;

(b) blades positioned in said slots, each blade having an outer surface engageable with the said core and an inner surface, said inner surface defining axially spaced-apart first cam grooves having inclined ramp surfaces;

(c) a cam reciprocable in said bore and being reciprocable between a first position and a second position, said cam defining axially spaced-apart second cam grooves having inclined ramp surfaces and being generally aligned with said first cam grooves;

(d) first bearing means interposed in said first and second grooves;

(e) second bearing means interposed between said arbor tube and said cam to support reciprocation of said cam relative to said arbor tube; and (f) pneumatic actuator means on said cam connectable to a source of air whereby said cam is reciprocable to a first position in which said first bearing means are positioned in said grooves to retract said blade and a second position in which said first bearing means are positioned in said grooves to radially extend said blades.

2. The arbor of claim 1 wherein said pneumatic actuator has a rotary connection for connection to a source of pressurized air.

* * * * *